US006698725B1

(12) United States Patent
Berry

(10) Patent No.: US 6,698,725 B1
(45) Date of Patent: Mar. 2, 2004

(54) SLOTTED FENCE POST CAP

(76) Inventor: Tracy L. Berry, 8206 Sundown Cir., Mooringsport, LA (US) 71060

( * ) Notice: Subject to any disclaimer, the term of this patent is extended or adjusted under 35 U.S.C. 154(b) by 276 days.

(21) Appl. No.: 09/662,034

(22) Filed: Sep. 14, 2000

(51) Int. Cl.[7] ..... F16B 7/08; E04H 17/14

(52) U.S. Cl. ..... 256/11; 256/60; 256/65.03; 256/65.12; 256/65.01

(58) Field of Search ..... 256/1, 11, 65.03, 256/65.12, 60, 65.01

(56) References Cited

U.S. PATENT DOCUMENTS

| | | | | | |
|---|---|---|---|---|---|
| 505,781 | A | * | 9/1893 | Vance | 256/21 |
| 699,509 | A | | 5/1902 | Finnegan | |
| 1,316,155 | A | * | 9/1919 | Frazier et al. | 256/65.05 |
| 2,062,408 | A | * | 12/1936 | Edge | 256/13.1 X |
| 2,212,455 | A | * | 8/1940 | Reed | 403/64 |
| 4,150,907 | A | | 4/1979 | Thurnauer | 403/234 |
| 4,767,232 | A | | 8/1988 | Francis | 403/91 |
| 4,844,420 | A | * | 7/1989 | Oster | 256/1 |
| 5,460,353 | A | * | 10/1995 | Rittenhouse | 256/1 |
| 5,547,169 | A | | 8/1996 | Russell | 256/67 |
| 5,584,469 | A | * | 12/1996 | Goodwin | 256/67 |
| 5,785,447 | A | | 7/1998 | Fonti et al. | 403/49 |

* cited by examiner

*Primary Examiner*—Gregory J. Binda
*Assistant Examiner*—Ernesto Garcia
(74) *Attorney, Agent, or Firm*—John M. Harrison

(57) ABSTRACT

A slotted cap for a corner or support post of a fence, particularly a chain link or "Cyclone" (trademark) or "Hurricane" (trademark) fence. In a preferred embodiment, the slotted fence post cap includes a cylindrical cap wall which is mounted on the upper end of the vertical fence post, and a horizontal adjusting slot is fitted on one side and a fixed nipple is fitted on the opposite side of the cap wall. The fixed nipple receives the horizontal top rail of a fixed fence segment or run, and the adjusting slot is fitted with an adjustable nipple which receives the top rail of an adjustable fence segment or run in construction of the fence. The adjustable nipple is typically bolted to the cap wall at the adjusting slot, and the bolt can be loosened to facilitate adjustment of the adjustable nipple and attached adjustable fence segment into a selected angular relationship with respect to the fixed fence segment. In another embodiment, an adjusting slot is provided in each side of the cap wall, and each receives one or more adjusting nipples. In still another embodiment, multiple adjustable nipples can be fitted to multiple slots intermittently provided in spaced-apart relationship in the horizontal plane of the cap wall to facilitate extending fence lines or segments in varying angular relationship with respect to each other from a common corner post.

2 Claims, 4 Drawing Sheets

SLOTTED FENCE POST CAP

BACKGROUND OF THE INVENTION

1. Field of the Invention

This invention relates to fences and in particular, to a slotted cap for corner or support posts of chain link or "Cyclone" (trademark) or "Hurricane" (trademark) fences. In a preferred embodiment the slotted fence post cap is characterized by a cylindrical cap wall which is topped by an inverted cone and mounted on a fence post or posts of the fence. A horizontal adjusting slot extends through the cap wall, typically about 180 degrees around one side thereof, and a fixed nipple extends from the cap wall on the opposite side of the adjusting slot. The horizontal top rail of a fixed fence segment is fitted in the fixed nipple. A bolt which extends from an adjustable nipple is seated in the adjusting slot, and the adjustable nipple receives the horizontal top rail of an adjustable fence segment. By sliding and tightening the bolt in the adjusting slot, a selected angle of the adjustable fence segment with respect to the fixed fence segment can be achieved in construction of the fence. A second adjustable nipple can be fitted to the adjusting slot to facilitate angular positioning of two adjustable fence segments and a fixed fence segment with respect to each other, as desired. In another embodiment, an adjusting slot is provided in each side of the cap wall, and each receives at least one adjusting nipple. In still another embodiment, multiple adjustable nipples can be fitted to multiple slots intermittently provided in the horizontal plane of the cap wall with or without a fixed nipple or nipples extending from the cap wall, to facilitate extending fence lines or segments in varying angular relationship with respect to each other and/or one or more fixed fence segments from a common corner post.

Conventional fence post caps are characterized by one or more extending nipples or receptacles for receiving the respective horizontal top rails of two or more fence lines or segments extending from the corner posts. These nipples typically extend in fixed relationship from the cap, normally at a ninety-degree angle with respect to each other in order to define the usually right-angle fence configuration at the comer post. However, on many occasions the area to be fenced is irregular in shape and various angles other than ninety degrees must be defined at the corner posts in order to accommodate the respective fence segments or runs. This facility requires the use of fence post caps having fixed projecting nipples at specified angles which are not always those angles necessary or required to precisely define the land area being fenced. While the conventional fixed nipple configuration of comer fence post caps generally proximates desired angles, frequently the fencing must be slightly curved or otherwise adjusted to accommodate the land area in question.

2. Description of the Prior Art

Various types of fence couplings have been long known in the prior art. Typical of these couplings is a "Coupling for Railings", detailed in U.S. Pat. No. 699,509, dated May 6, 1902, to Finnegan. The patent details a coupling for connecting hand rail segments of a hand rail for stairs, which coupling includes threaded T-fittings and end fittings that are joined at the railing intersections. U.S. Pat. No. 4,150,907, dated Apr. 24, 1979, to Thumauer, details a "Stanchion Connector Assembly" which is adapted to provide an anchor for the terminal end of a ramp rail. The stanchion includes a curved slotted ball attached to a vertical member and a ramp rail attached to a ball receptacle which is attached to the opposite curved face of the ball to facilitate adjustment of the ramp rail. U.S. Pat. No. 4,767,232, dated Aug. 30, 1988, to Francis, details a "Hinge Joint For Tubular Rail and Post Members". The hinge joint includes a segmented fitting having a curved end for attachment to the congruent surface of a vertical pipe member, and the opposite end of the segmented fitting is slotted and curved to receive a correspondingly-slotted and curved horizontal pipe member for attaching the horizontal pipe member to the vertical pipe member. U.S. Pat. No. 5,547,169, dated Aug. 20, 1996, to Russell, details a "Fence Assembly With Swivel Bracket". The fence assembly includes vertical posts and horizontal rails connected to each other by adjustable connecting members. Each connecting member is characterized by a fitting fixedly attached to the vertical post, and the fitting has a hollow interior with a removable top cap to facilitate inserting an end of the rail into the fitting. The rail is pivotally bolted to the fitting before replacing the top cap. U.S. Pat. No. 5,785,447, dated Jul. 28, 1998, to Fonti, et al., details a "Connector for Structural Apparatus" which is characterized by a split ring for bolting to a vertical post and a saddle adapted to fit on one segment of the split ring and receive a horizontal rail to mount the rail on the post.

An object of this invention is to provide a new and improved fence post cap for fence posts, which fence post cap facilitates selected angular positioning of at least one fence segment or line of a fence with respect to another fence segment or line of the fence.

Another object of this invention is to provide a fence post cap which is mounted on corner or support posts of a fence and facilitates fencing of a land area that has an irregular shape.

Still another object of this invention is to provide a new and improved fence post cap for fence support posts, which fence post cap is characterized by an adjusting slot extending through a cylindrical cap wall parallel to the bottom edge of the cap wall for accommodating at least one adjustable nipple; and at least one fixed nipple extending from the opposite side of the cap wall, wherein the horizontal top rail of an adjustable fence segment is mounted in the adjustable nipple or nipples, respectively, and the horizontal top rail of a fixed fence segment is mounted in the fixed nipple to facilitate positioning the adjustable fence segment or segments in a selected angular relationship with respect to each other and the fixed fence segment in construction of a chain link or cyclone fence.

A still further object of this invention is to provide a new and improved, slotted fence post cap for capping the corner post in fences such as chain link fences, which cap includes multiple intermittent slots for each receiving an adjustable nipple and extending two or more fence runs or legs in selected angular relationship with respect to each other.

Yet another object of this invention is to provide a new and improved, slotted fence post cap for capping the corner post in fences such as chain link fences, which cap includes a fixed nipple extending from one side of the cylindrical cap for receiving the horizontal top rail of a fixed fence segment and multiple intermittent slots provided in spaced-apart relationship to each other in the cap for each receiving an adjustable nipple and extending one or more fence runs or legs in selected angular relationship with respect to each other and the fixed fence segment.

Another object of this invention is to provide a slotted fence post cap for capping a post of a fence such as a chain link fence, which cap includes at least one adjustable nipple fitted to each of two horizontal adjusting slots provided in respective sides of the cylindrical cap wall to facilitate adjustment of the adjustable nipples and attached adjustable legs or segment runs of the fence at a selected angular relationship with respect to each other.

SUMMARY OF THE INVENTION

These and other objects of the invention are provided in a new and improved, slotted fence post cap for capping fence support posts and comer posts in particular, which slotted fence post cap is characterized in a first preferred embodiment by an adjusting slot provided in a cylindrical cap wall and extending substantially parallel to the bottom opening of the cap wall for accommodating at least one adjustable nipple, and a fixed nipple extending from the cap wall opposite the adjusting slot. The adjustable and fixed nipples facilitate the installation of a pair of fence segments or runs at a selected angular relationship with respect to each other. In another embodiment, a pair of adjusting slots are provided in the cap in diametrically-opposed relationship to each other and a pair of fence segments can be fitted to the respective adjusting slots for angular adjustment with respect to each other. In still another embodiment, at least one fixed nipple is provided on the fence cap for attachment to the horizontal top rail of a fixed fence segment and multiple intermittent slots with respective adjustable nipples are provided on the fence cap for attachment to the top rails of respective adjustable fence segments and installing the adjustable fence segments at selected angles with respect to each other and the fixed fence segment. In yet another embodiment, multiple adjustable nipples can be fitted to multiple slots intermittently provided in the horizontal plane of the adjustable cap, around the circumference thereof to facilitate extending fence lines or segments in varying angular relationship with respect to each other from a common corner post.

BRIEF DESCRIPTION OF THE DRAWINGS

The invention will be better understood by reference to the accompanying drawings, wherein.

DESCRIPTION OF THE PREFERRED EMBODIMENTS

Figure 2:
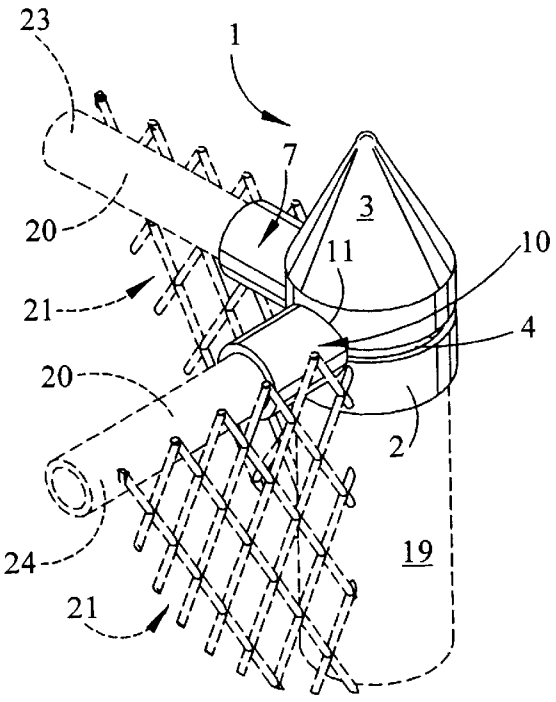
FIG. 2 is a perspective view of the slotted fence post cap illustrated in FIG. 1, with the adjustable fence segment positioned at a 90 degree angle with respect to the fixed fence segment.
Figure 3:
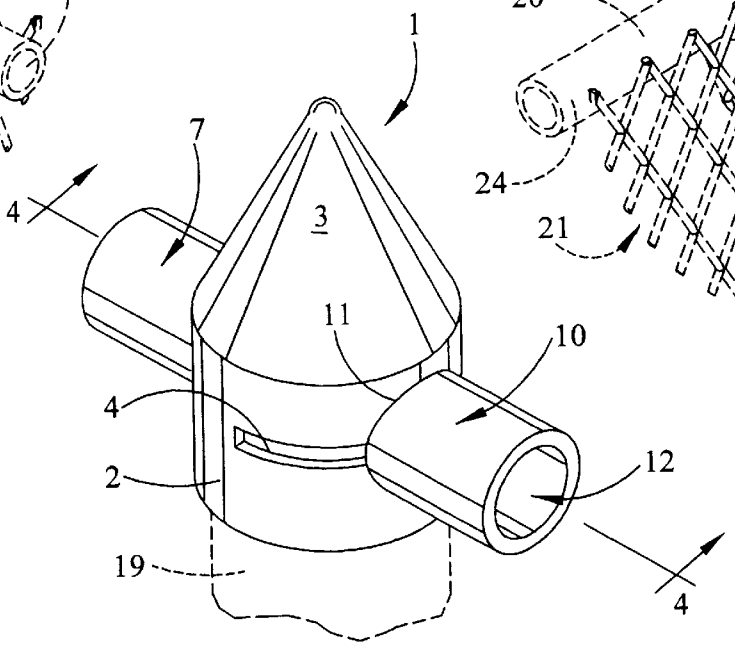
FIG. 3 is an enlarged perspective view of the slotted fence post cap illustrated in FIG. 1.
Figure 1:
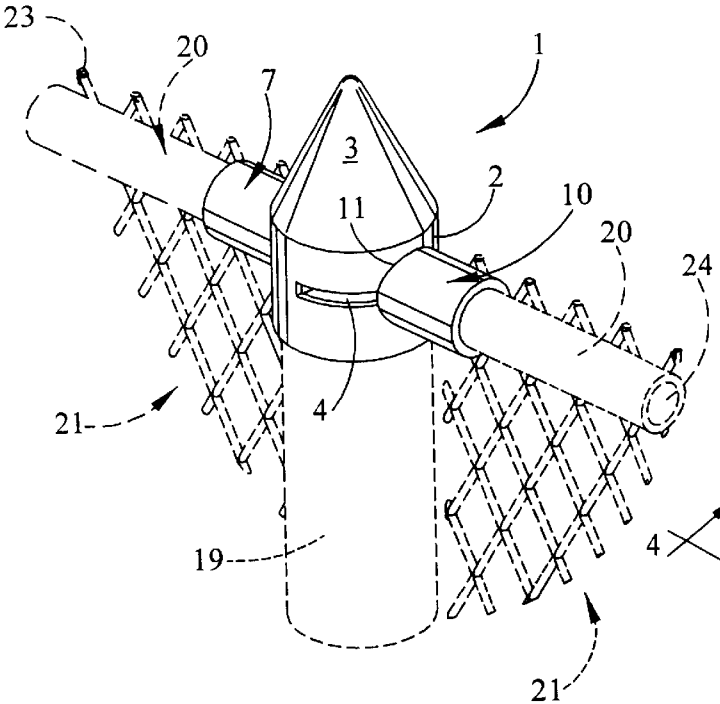
FIG. 1 is a perspective view of a preferred embodiment of the slotted fence post cap of this invention, with a fixed nipple and an adjustable nipple component positioned at a substantially 180 degree angle with respect to each other, and fixed and adjustable fence segments of a chain link fence fitted to the fixed nipple and adjustable, nipple, respectively.
Figure 4:
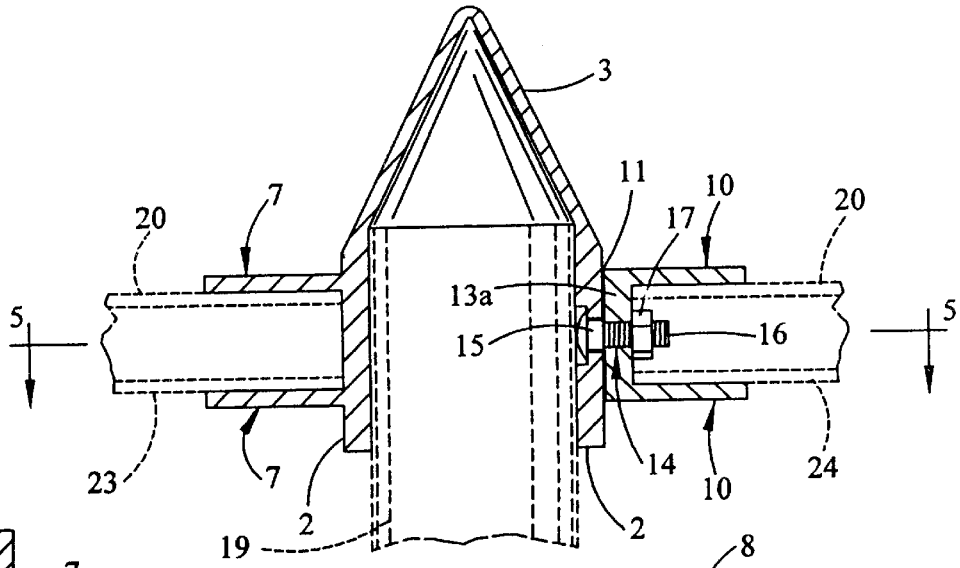
FIG. 4 is a sectional view, taken along section line 4—4 of the slotted fence post cap illustrated in FIG. 3.
Figure 5A:
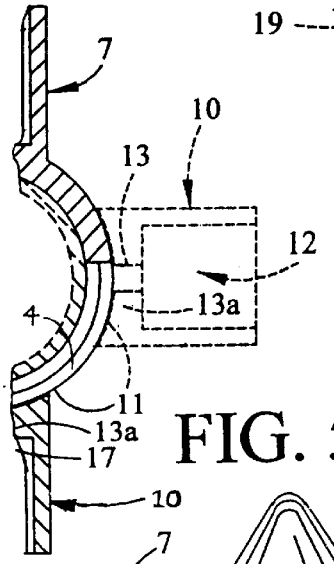
FIG. 5A is a partial sectional view, taken along section line 5—5 of the slotted fence post cap illustrated in FIG. 4, illustrating a third nipple adjustably engaging the slotted fence post cap in another embodiment of the invention.
Figure 5:
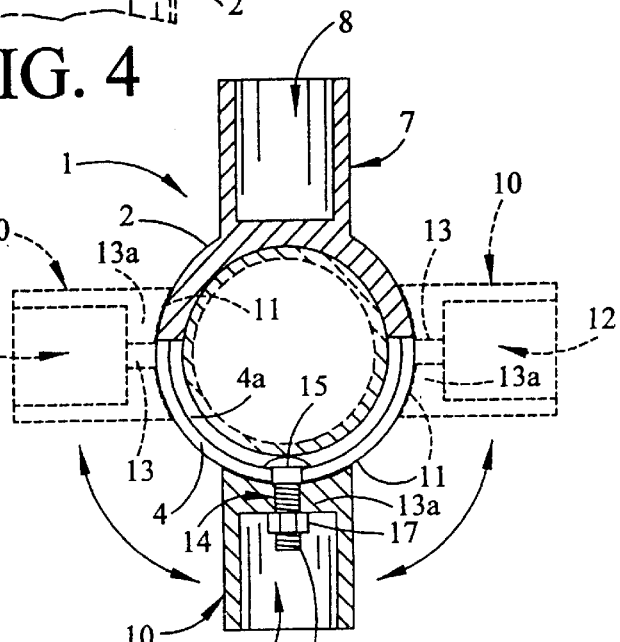
FIG. 5 is a sectional view, taken along section line 5—5 of the slotted fence post cap illustrated in FIG. 4.
Figure 6:
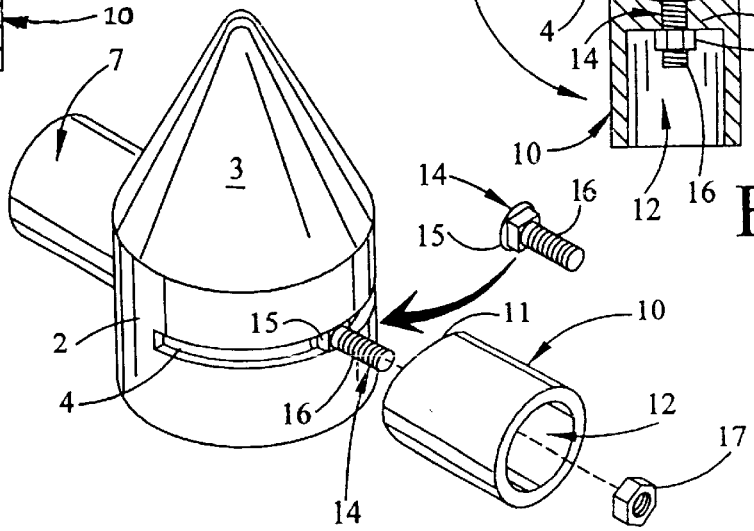
FIG. 6 is an exploded, perspective view of the slotted fence post cap illustrated in FIG. 3, more particularly illustrating mounting of the adjustable nipple into position in a horizontal adjustment slot by means of a bolt.

Referring initially to FIGS. 1–5 of the drawings, a first preferred embodiment of the slotted fence post cap of this invention is generally illustrated by reference numeral 1 and includes a rounded, cylindrical cap wall 2, topped by a cone 3 and having an elongated adjusting slot 4 of selected length, typically extending about 180 degrees around the cap wall 2, and is horizontally disposed when the slotted fence post cap 1 is mounted on the upper end of a vertical fence post 19, as illustrated in FIGS. 1 and 2. The slotted fence post cap 1 is characterized by a typically cylindrical fixed nipple 7 that extends in perpendicular relationship with respect to the cap wall 2 and is typically fixed to or molded integrally with the cap wall 2, as desired. The fixed nipple 7 is characterized by a fixed nipple bore 8, illustrated in FIG. 5, designed to receive a smaller-diameter, horizontal top rail 20 component of a fixed segment 23 of a chain link or cyclone fence 21, as further illustrated in FIGS. 1 and 2. An adjustable nipple 10 is characterized by curved adjustable nipple face 11 that corresponds to the curvature of the cap wall 2 and fits against the cap wall 2 at the adjusting slot 4 as further illustrated in FIGS. 1–5. The adjustable nipple 10 is further characterized by an adjustable nipple bore 12 that communicates with the wall slot 4 by means of a bolt opening 13 in a rear wall 13*a* of the adjustable nipple 10 to accommodate the threaded shank 16 of a nipple mount bolt 14, as illustrated in FIG. 5. The bolt head 15 of the nipple mount bolt 14 is retained in a slot recess 4*a* which is provided in the cap wall 2 in the interior of the slotted fence post cap 1. The bolt head 15 is typically coextensive with the adjusting slot 4, to facilitate adjustable mounting of the adjustable nipple 10 on the cap wall 2 by means of a nut 17, typically using a socket (not illustrated) inserted into the adjustable nipple bore 12 and engaging the nut 17. Accordingly, it will be appreciated from a consideration of FIGS. 1–5 of the drawings that while the fixed nipple 7 is fixed in position with respect to the cap wall 2, the adjustable nipple 10 can be slidably adjusted along the length of the adjusting slot 4 by loosening the nut 17 on the threaded shank 16. Accordingly, the adjustable nipple 10 can be positioned as illustrated in FIG. 1 to facilitate positioning the adjustable fence segment 24 in aligned, 180-degree relationship with respect to the fixed fence segment 23. Alternatively, as illustrated in FIG. 2 the adjustable nipple 10 of the slotted fence post cap 1 can be adjusted to the position such that the adjustable fence segment 24 and the fixed fence segment 23 are disposed at a substantially 90-degree relationship with respect to each other. It will be further appreciated from a consideration of FIG. 5 that the adjustable nipple 10 can be positioned at any point along the adjusting slot 4 and the nut 17 tightened on the threaded shank 16 to define any desired selected angle between the respective fixed fence segment 23 and adjustable fence segment 24, depending upon the required configuration of the fence 21.

Referring now to FIGS. 1, 4, 5 and 5A of the drawings, the facility for adjusting the adjustable nipple 10 into substantially any position along the entire length of the adjusting slot 4 is illustrated. For example, while the adjustable nipple 10 can be positioned as illustrated in FIGS. 1 and 5 wherein the fixed fence segment 23 and adjustable fence segment 24 of the fence 21 are aligned in a substantially 180-degree relationship, the adjustable nipple 10 can equally well be adjusted into either one of the two positions illustrated in phantom in FIG. 5 or at any position in between, to configure the respective fixed fence segment 23 and adjustable fence segment 24 in a 90-degree angle, for example, as illustrated in FIG. 2, or a 180-degree angle or any angle in between with respect to each other. As illustrated in phantom in FIG. 5A, a third nipple 10 may adjustably engage the cap wall 2 in the same manner as the second nipple 10 heretofore described with respect to FIG. 5. Accordingly, the second nipple 10 (shown in solid lines) and the third nipple 10 (shown in phantom) may be adjustably mounted in a common adjusting slot 4. An adjustable fence segment 24 (FIG. 1) may thus be attached to the second and third nipples 10 and positioned at selected angular positions with respect to each other.

Figure 7:
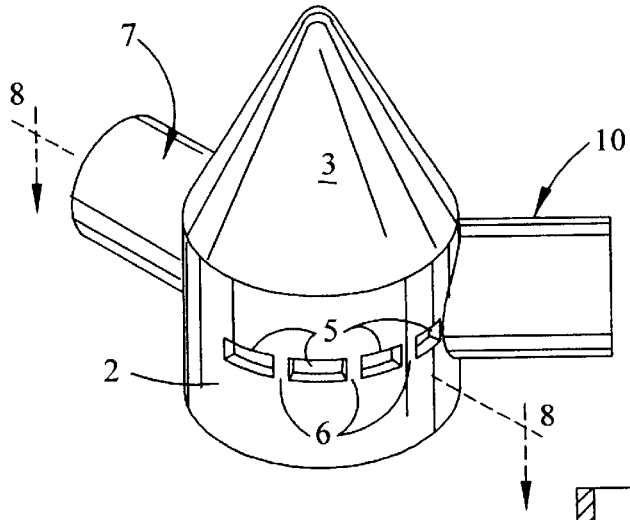
FIG. 7 is a perspective view of an alternative embodiment of the slotted fence post cap, having a single fixed nipple and wherein multiple horizontal intermittent slots are provided for attaching multiple adjustable nipples to the cap.
Figure 8:
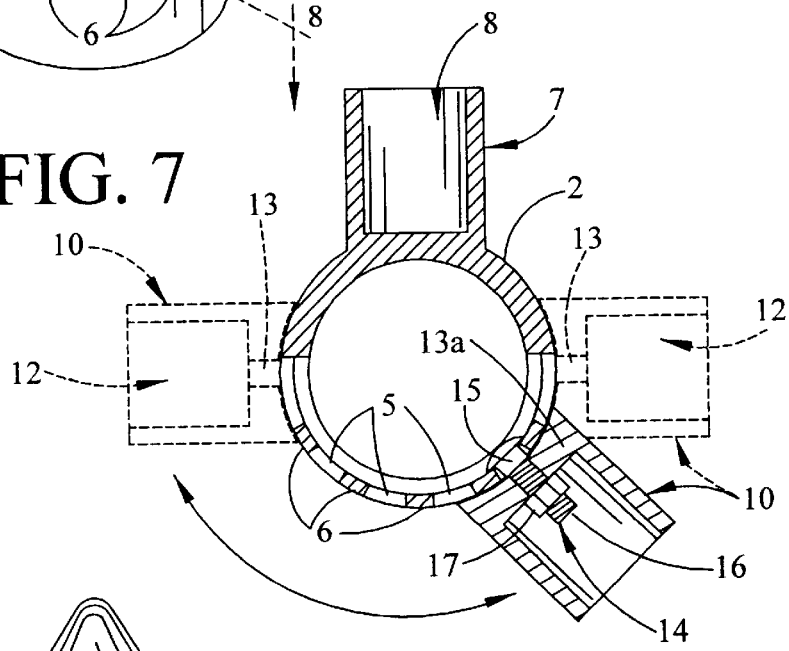
FIG. 8 is a sectional view, taken along line 8—8 of the slotted fence post cap illustrated in FIG. 7, more particularly illustrating multiple alternative positions of the adjustable nipple with respect to the fixed nipple on the fence post cap.
Figure 9:
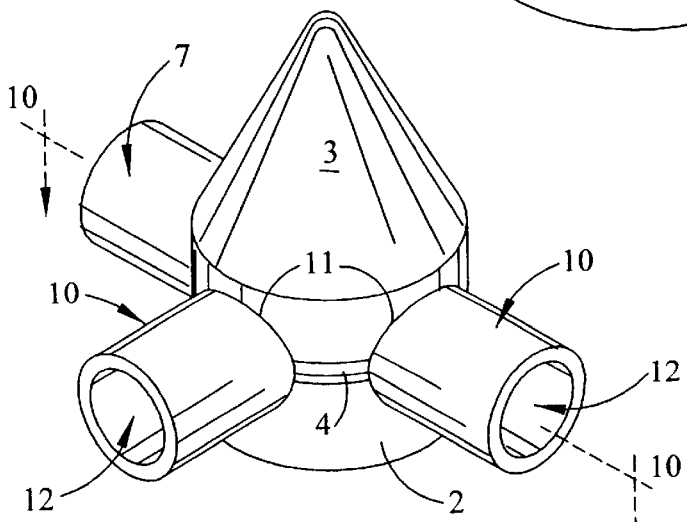
FIG. 9 is a perspective view of a slotted fence post cap, fitted with a single fixed nipple, and a pair of adjustable nipples located in a common horizontal adjusting slot provided in the cap wall.

Referring now to FIGS. 7 and 8 of the drawings, in yet another embodiment of the invention, multiple, aligned intermittent slots 6, separated by slot dividers 5, are provided in the cap wall 2, and each can receive the nipple mount bolt 14 of an adjustable nipple 10, as illustrated in FIG. 8. It will be appreciated that the desired number of intermittent slots 6 and the size of the respective slot dividers 5 may be varied to facilitate a selected adjustment of multiple adjustable nipples 10 at respective ones of the intermittent slots 6, as desired.

Figure 10:
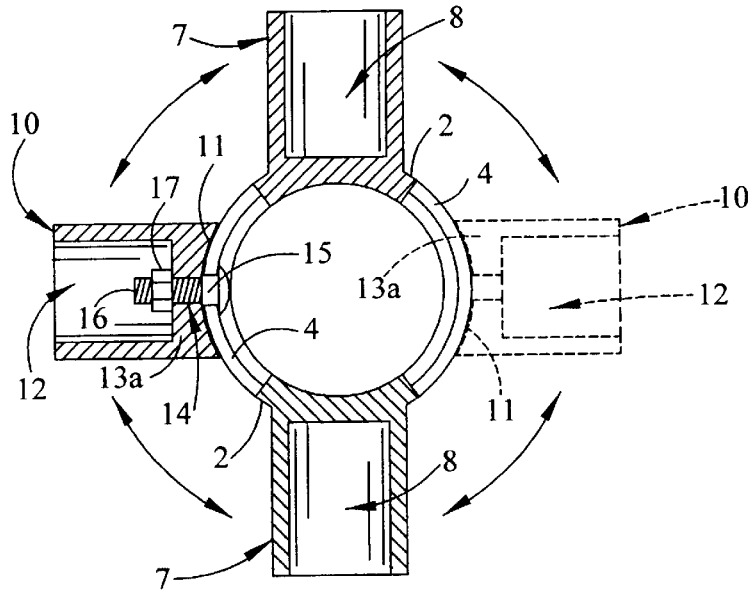
FIG. 10 is a sectional view, taken along section line 10—10 of the slotted fence post cap illustrated in FIG. 9, more particularly illustrating still another embodiment of the fence post cap wherein a pair of fixed nipples is provided on the cap in diameticaly-opposed relationship and a pair of adjustable nipples is fitted in respective opposing adjusting slots in the cap.

Referring next to FIG. 10 of the drawings, in yet another embodiment of the invention, a pair of adjustable nipples 10 (one of which is illustrated in phantom) can be joined to respective, diametrically-opposed adjusting slots 4 and, along with a fixed nipple 7, and used to extend respective adjustable fence segments 24 (FIG. 1) in selected directions and at selected angles with respect to each other and with respect to a fixed fence segment 23 (FIG. 1) from a common fence post 19 (illustrated in FIGS. 1 and 2). Similarly, as illustrated in FIG. 10 a pair of fixed nipples 7 can be provided, typically in oppositely-disposed relationship on the cap wall 2 of the slotted fence cap 1 with one or two (or more) adjustable nipples 10 located in the oppositely-disposed adjusting slots 4 provided in the cap wall 2. These adjustable nipples 10 are, like the embodiments earlier described, easily adjustable along the entire lengths of the adjusting slots 4 to facilitate positioning of the respective adjustable fence segments 24 in selected angular relationship with respect to each other and the fixed fence segments or runs 23, secured by the respective fixed nipples 7 at the horizontal top rails 20 of the fixed fence segments 23.

Figure 11:
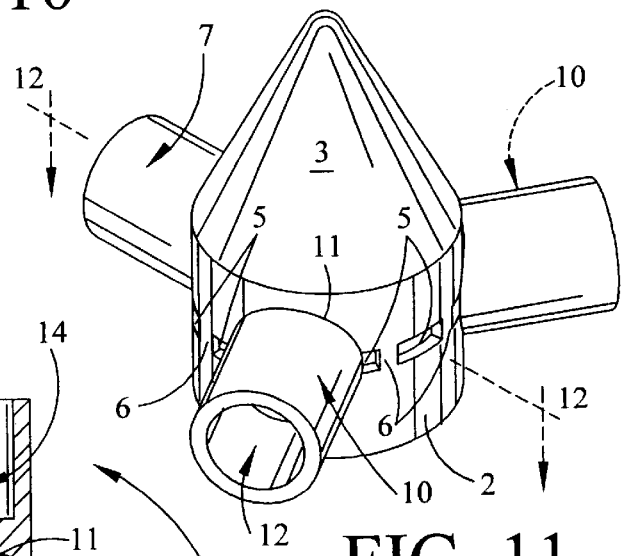
FIG. 11 is a perspective view of yet another embodiment of the slotted fence post cap, having a single fixed nipple and two adjustable nipples mounted in respective intermittent slots provided in horizontal spaced-apart relationship in the cap wall.

Referring to FIG. 11 of the drawings, in similar manner, intermittent slots 6 of selected length and separated by a selected number of slot dividers 5 of selected width can be provided in the cap wall 2 of the slotted fence cap 1, in addition to the fixed nipple 7. Under such circumstances, one or more adjustable nipples 10 can be secured to respective intermittent slots 6 to extend the rails 20 of the respective adjustable fence segments 24 in selected angular relationship with respect to each other and with respect to a fixed fence segment 23 (FIG. 1), the horizontal top rail 20 of which is mounted in the fixed nipple 7 as heretofore described.

Figure 12:
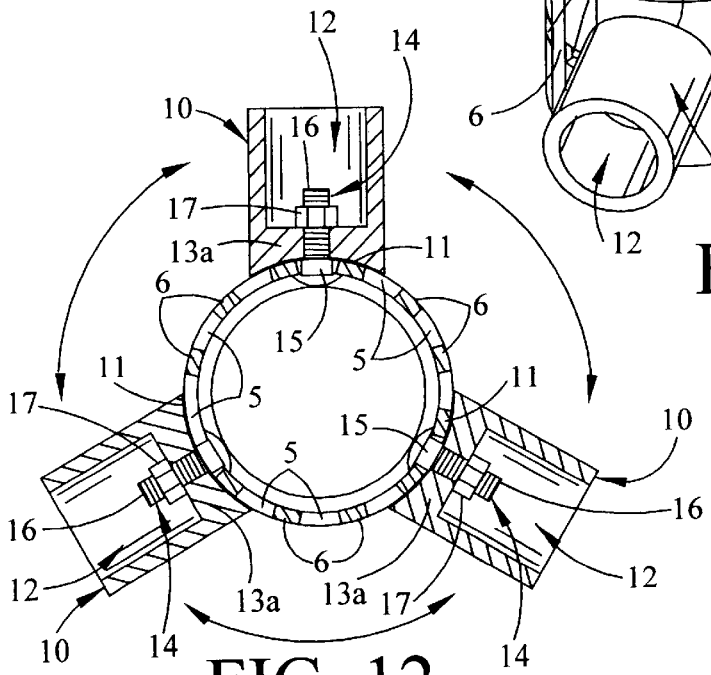
FIG. 12 is a sectional view, taken along section line 12—12 of the slotted fence post cap illustrated in FIG. 11, more particularly illustrating another embodiment of the fence post cap wherein three adjustable nipples are mounted in respective intermittent slots provided in horizontal spaced-apart relationship in the cap wall.

Referring next to FIG. 12 of the drawings, multiple intermittent slots 6, separated by slot dividers 5, are provided in the cap wall 2 in spaced-apart relationship to each other around the circumference of the cap wall 2. Three adjustable nipples 10 can be fitted to respective intermittent slots 6 in equiangular relationship with respect to each other to facilitate positioning of the rails 20 of the respective adjustable fence segments 24, illustrated in FIGS. 1 and 2, into equiangular relationship from a common fence post 19 (also illustrated in FIGS. 1 and 2).

It will be appreciated by those skilled in the art that the slotted fence post cap 1 of this invention is versatile and can be utilized on substantially any fencing 21 that requires use of fence post caps for mounting fence rails to fence posts. The slotted fence post cap 1 can thus be positioned on the fence post 19 to extend the rails 20 of an adjustable fence segment 24 in alignment as illustrated in FIG. 1 or in a ninety-degree relationship as illustrated in FIG. 2 with respect to a fixed fence segment 23, using an adjustable nipple 10 and a fixed nipple 7. Furthermore, the adjusting slot 4 can be singular or multiple and oppositely-disposed, and the intermittent slots 6 any selected number and spacing as described above to define fencing 21 with fixed fence segments 23 and adjustable fence segments 24 disposed in any selected angular relationship depending upon the shape of the property to be fenced.

It is understood that any desired number of the fixed nipples 7 can extend from the cap wall 2 in combination with any desired number of the adjustable nipples 10 which utilize either the elongated adjusting slot 4 or intermittent slots 6, described above. Referring again to FIG. 10 of the drawings, it is understood that the diametrically-opposed fixed nipples 7 can be omitted from the cap wall 2 and two or more adjustable nipples 10 mounted in the remaining respective adjusting slots 4, as illustrated, to facilitate angular adjustment of respective adjustable fences segments 24 (FIG. 1), attached to the adjustable nipples 10, with respect to each other. Further in the alternative, the fixed nipples 7 in FIG. 10 can be replaced by a pair of intermittent slots 6 (FIG. 8) which, in combination with the adjusting slots 4, facilitate attachment of a selected number of the adjusting nipples 10 to the cap wall 2. Still further in the alternative, one of the adjusting slots 4 can be provided in the cap wall 2 in combination with a selected number of the intermittent slots 6 to facilitate attachment of a selected number of adjustable nipples 10 to the cap wall 2, with the adjusting slot 4 provided on one side of the cap wall 2 and a selected number of the intermittent slots 6 provided in spaced-apart relationship to each other on the opposite side of the cap wall 2.

It will be appreciated by those skilled in the art that the slotted fence post cap 1 is particularly well-suited to use in that fencing known as chain link fencing or "Hurricane" (trademark) fencing where the fence post caps that attach to the respective fence posts are generally shaped of aluminum with the fixed nipple or nipples typically cast in place. Accordingly, the slotted fence post cap 1 can be constructed by casting one or more adjusting slots 4 either in continuous or oppositely-disposed relationship, or the intermittent slots 6 with slot dividers 5 according to techniques that are well known to those skilled in the art, since the adjustable nipples 10 are quite easily constructed with a curvature that matches the cap wall 2.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A fence post cap for mounting on a fence post and securing first and second fence segments at a selected angle with respect to each other, said fence post cap comprising a cap wall; a cone provided on said cap wall; a first nipple carried by said cap wall for attachment to the first fence segment; a second nipple adjustably engaging said cap wall for attachment to the second fence segment: and an elongated adjusting slot provided in said cap wall and a bolt engaging said second nipple and said adjusting slot for adjustably mounting said second nipple on said cap wall.

2. The fence post cap of claim 1 wherein said first nipple is fixedly attached to said cap wall.

* * * * *